United States Patent [19]

Ross et al.

[11] Patent Number: 4,693,763

[45] Date of Patent: Sep. 15, 1987

[54] WET LOADING EXPLOSIVE

[75] Inventors: Cyrus A. Ross; Eberhard Thurow, both of Kirkland Lake, Canada

[73] Assignee: Les Explosifs Nordex Ltee/Nordex Explosives Ltd., Kirkland Lake, Canada

[21] Appl. No.: 945,892

[22] Filed: Dec. 24, 1986

[51] Int. Cl.[4] ..... C06B 45/34

[52] U.S. Cl. ..... 149/8; 149/60; 149/61; 149/75; 149/76; 149/85; 149/109.6; 252/308; 252/309; 252/315.2

[58] Field of Search ..... 149/8, 60, 61, 75, 76, 149/85, 109.6; 252/308, 309, 315.2

[56] References Cited

U.S. PATENT DOCUMENTS

| | | | |
|---|---|---|---|
| 4,111,727 | 9/1978 | Clay | 149/2 |
| 4,141,767 | 2/1979 | Sudweeks et al. | 149/21 |
| 4,187,546 | 1/1980 | Clay | 149/2 |
| 4,384,903 | 5/1983 | Enever | 149/41 |
| 4,534,809 | 8/1985 | Takeuchi et al. | 149/46 |

*Primary Examiner*—Stephen J. Lechert, Jr.
*Attorney, Agent, or Firm*—Sim & McBurney

[57] ABSTRACT

A water resistant explosive composition is disclosed for use in wet blasting holes. The composition comprises ammonium nitrate prills coated with a glycol and oil emulsion to render the prills waterproof. The coated prills are mixed with quick hydrating and self-complexing guar gums. The compositions can be poured directly into water filled blasting holes. The guar gums in the presence of cross-linking agent form a gel in the bore hole to lend stability to the composition until exploded. The composition has excellent shooting properties.

24 Claims, No Drawings

WET LOADING EXPLOSIVE

FIELD OF THE INVENTION

This invention relates to explosive compositions which can be used in damp or water filled blast holes.

BACKGROUND OF THE INVENTION

It is very difficult and usually quite expensive to provide an explosive composition which is stable and reliable when charged into blast holes which are either damp or contain water. Many explosive compositions, as used in damp environments, require that the composition itself be packaged in plastic bags or the like to prevent water degrading the explosive mix. This results in costly packaging methods which require special handling care. As appreciated, should the bag structure be perforated or in some way damaged, the explosive contents can be spoiled by water.

A water resistant explosive composition is disclosed in Canadian patent No. 877,227. The composition comprises in combination ammonium nitrate prills mixed with a solution of ammonium nitrate in combination with a setting agent, such as alkaline earth metal oxides. The composition, as mixed, is allowed to set and harden in the shape of the mold into which it is poured. The hardened composition can then be of a shape which will permit introduction to blast holes and the like for purposes of blasting. This type of composition has to be made at a full scale plant and must be cast into desired shapes. The material does not lend itself then to the shape of the cavity into which it is introduced and hence ineffective blasting occurs.

It is appreciated that there are a wide variety of explosive slurries available for use in blasting operations. However, such slurries usually tend to have low water resistance and degrade if left too long in a blast hole which either admits water or contains water. Such explosive slurries are usually made with the use of gelling and/or thickening agents which include natural gums and synthetic gels, such as polyacrylamides and the like. An example of such blasting slurries is disclosed in Canadian patent No. 933,780.

In Canadian patent No. 888,102, water resistivity is imparted to an explosive composition by use of synthetic gelling and/or thickening agents. The thickening agents may include suitable gums, such as guar gums which are cross-linked by a cross-linking agent such as sodium dichromate or a saturated solution of ammonium nitrate in liquid ammonia (Divers liquid). The composition, as prepared in accordance with this patent, is a dry explosive composition consisting in admixture of ammonium nitrate prills with particulate light metal, a detonable organic sensitizer and a thickening agent. However when such compositions are introduced into water filled blast holes, the ammonium nitrate prills tend to degenerate.

Other forms of water resistant explosive compositions are disclosed in Canadian patent No. 804,541. This patent discloses coating ammonium nitrate prills with metalic stearates or oleates to which fuel oil is blended. The mixture is subsequently blended with ammonium nitrate solutions containing guar gums which, after blending with the coated ammonium nitrate prills, is cross-linked with ammonia to provide a waterproof paste slurry or emulsion depending on the rate of mixing and the amount of ammonium nitrate solution used. Olney, U.S. Pat. No. 4,138,281, discloses an emulsification of hot ammonium nitrate solutions using fuel-oil and wax carriers with an organic stearate or oleate as an emulsification agent. To sensitize this composition, micro air bubbles are added chemically or physically using microspheres of glass borates, etc. Both of these explosive compositions contain water, possibly as high as 20%. As water does not explode, considerable energy is taken out of the system. In practice, such compositions have been blended with straight ammonium nitrate fuel-oil blasting materials to reduce cost of compounding. This practice results in the velocity of detonation being lowered to that of the inferior ammonium nitrate fuel-oil blasting compositions.

SUMMARY OF THE INVENTION

In accordance with this invention, a water resistant blasting composition is provided.

According to an aspect of the invention, the explosive composition comprises in admixture the following components:

(i) granular oxidizing agent;

(ii) a hydratable self-complexing gelling agent; and (iii) the granular oxidizing agent being coated with an emulsion to render thereby the granules water resistant, the emulsion consisting of an oil emulsified with a water soluble densifying agent which has a density equal to or greater than water.

The explosive composition includes the components in a weight ratio which provides an explosive mixture.

According to another aspect of the invention, a water resistant explosive composition comprises:

(i) approximately 4.3% to 27% by weight of an oil/glycol emulsion including 1% to 6% by weight of an immiscible emulsifiable liquid oil, 0.3% to 5% by weight of an emulsifier and 3% to 16% by weight of an glycol, said emulsion having a density equal to or greater than water;

(ii) approximately 70% to 95% by weight of a granular oxidizing salt coated with the oil/glycol emulsion to impart water resistance to the granules;

(iii) approximately 0.7% to 3.0% by weight of a hydratable self-complexing gelling agent; and (iv) approximately 0% to 12% by weight of water.

According to another aspect of the invention, a glycol-in-oil emulsion for use in coating a granular oxidizing agent used in an explosive comprises sufficient glycol in said emulsion to provide a density equal to or greater than 1. The oil is selected from the group consisting of petroleum oils including heavy motor oils and light oils; vegetable oils; dinitrotoluene, refined mineral oils and white mineral oils. An emulsifier is selected from the group consisting of sorbitan; fatty acid ester of sorbitan; mono- and diglycerides of fat-forming fatty acids; polyoxyethylene sorbitol esters; polyoxyethylene (4) lauryl ether; polyoxyethylene (2) ether; polyoxyethylene (2) stearyl ether; polyoxyalkylene oleate; polyoxyalkylene oleyl acid phosphate; substituted oxazolines; phosphate esters; metallic stearates and emulsified polyacrylamides. The glycol is selected from the group consisting of ethylene glycol; diethylene glycol and propylene glycol.

According to another aspect of the invention, a process for coating granular oxidizing agent used in an explosive composition to impart water resistance thereto comprises coating the granules with an emulsion. The emulsion is formed by emulsifying a glycol in an oil fuel source in the presence of emulsifying agent.

The granules are coating with the emulsion to form coated water repelling granules.

According to another aspect of the invention, a process of charging with an explosive a blast hole which contains water comprises charging the blast hole with the explosive composition according to this invention where the composition is essentially free of water.

DETAILED DESCRIPTION OF THE PREFERRED EMBODIMENTS

In accordance with this invention, an explosive composition is provided which may be loaded directly into blast holes containing water. The composition does not deteriorate in the presence of water. Its density is such that it sinks in water to the bottom of the blast hole to fill same. When used in combination with self-complexing hydratable agents which in the presence of water form a gel, the introduced charge of explosives is stabilized by the gel such that the explosive remains in the bore until exploded. This is accomplished by blending a glycol in oil emulsion with the granular oxidizing agent, such as ammonium nitrate, and treating the mixture with quick hydrating and self-complexing agents, such as guar gums, to provide a granular explosive which can be poured directly into water of the bore or blast hole. It is appreciated that the oxidizing agent may have a variety of granular structures. Ammonium nitrate is commonly used and is available in a granular prill form. The prills are porous as supplied in the common commercial form.

This mixture has the desired water resistance with the desired fuel oil stability and by use of the self-complexing agent in the presence of water are cross-linked to form a slurry or gel in the blast hole. It has been found that such compositions have excellent shooting properties.

The explosive composition, according to this invention, may be prepared either at a plant or at a mixing site in the field such that the prepared explosive may be introduced directly from the mixer into the blast holes. As a result, there is no need to transport the mixed explosive composition. Instead, the individual components thereof may be transported on an appropriate mixing truck or the like.

One of the problems with prior ammonium nitrate fuel oil explosive mixtures is that the fuel oil has a density less than water. Hence when fuel oil coated the prills were poured into a bore hole, the fuel oil tended to be washed off the surface of the prills resulting in a non-explosive composition. In accordance with this invention, the coating of the oxidizing agent prills with a glycol-in-oil emulsion, which is heavier than water, will not wash off. The density of the porous prills when filled with water is greater than water so that the emulsion coated prills sink to the bottom of the blast hole and fill same when being charged.

The glycol-in-oil emulsion may be prepared at ambient temperature using any of the commercially available emulsifiers, such as sorbitan; fatty acid esters of sorbitan; mono- and diglycerides of fat-forming fatty acids; polyoxyethylene sorbitol esters; polyoxyethylene (4) lauryl ether; polyoxyethylene (2) ether; polyoxyethylene (2) stearyl ether; polyoxyalkylene oleate; polyoxyalkylene oleyl acid phosphate; substituted oxazolines; phosphate esters; metallic stearates and emulsified polyacrylamides.

Of these emulsifiers, the fatty acid esters of sorbitan may include sorbitan monolaurate; sorbitan monooleate; sorbitan trioleate; sorbitan monoplamitate; sorbitan monostearate, and sorbitan tristearate. The polyoxyethylene sorbitol esters may include polyoxyethylene sorbitan monooleate and polyethylene sorbitol beeswax derivatives.

Suitable glycols include ethylene glycol; diethylene glycol and propylene glycol, all of which have a density significantly greater than one.

Suitable oils which act as a source of fuel in the explosion may be selected from the group consisting of petroleum oils including heavy motor oils and light oils; vegetable oils; dinitrotoluene; refined minerals and white mineral oils.

The selected glycol, emulsifier and oil are mixed in a suitable mixer which provides sufficiently high speed mixing to form a suitable stable emulsion of glycol and oil. Although the resultant physical characteristics of the emulsion are not fully understood, it is believed that the fuel oil coats the glycol droplets preventing their normal tendency to dissolve in water when the emulsion coated prills are introduced into bore holes containing water. The glycols, which have a density significantly greater than one, result in an emulsion having a density also greater than one. Furthermore, the glycol provides a supplemental energetic fuel during detonation. The fuel oil has an affinity for the surfaces of the oxidizing agent prills being coated.

It is theorized that, during mixing of the glycol and oil emulsion with the oxidizing prills, such as ammonium nitrate prills, the emulsion in coating the surface of the prills traps micro air in the prills. The affinity of the ammonium nitrate for the fuel oil causes the emulsion to adhere to the prills. Due to the fuel oil surrounding the droplets of glycol, a stable emulsion is formed which has a density of one or greater. Hence when the prills are introduced to a bore hole containing water, the fuel oil does not float off of the prills; instead, remains adhered to the surfaces of the prills even when they are under water. Due to heavier glycol droplets being encapsulated by the oil, the glycol does not go into solution in the water of the blast hole, nor does the oil float or wash off the surface of the porous prills.

It is appreciated that the granular prills of oxidizing agent may be those commonly used in explosive compositions. Such agents include salts, such as ammonium nitrate; alkali metal and alkaline earth metal nitrites and nitrates; perchlorates and mixtures thereof. The alkali metal and alkaline earth metal nitrates include sodium nitrate and calcium nitrate. The perchlorates include sodium perchlorate, potassium perchlorate and ammonium perchlorate. The preferred form of oxidizing agent is the ammonium nitrate prill which is commercially available in industrial grade prills with a porous texture and having a poured density in the range of 0.7 to 0.9 grams/cc. The prills have a porous structure, so that the apparent density of the prills is less than 1.0. However, solid ammonium nitrate has a density of approximately 1.6 gm/cc. As a result, when the porous prills are poured into water, they immediately sink due to water filling the pores.

The prills coated with the glycol and oil emulsion may be poured directly into blast holes which may or may not contain water. One problem with this though is, should the blast holes include fissures or cracks which will allow material to flow out of the blast holes, a loss of explosive composition can result. The prills are flowable in this state and may over time flow out of the blast hole resulting in loss of effectiveness of the explosive material. To prevent this flow of material after introduced into the blast holes and to add stability to the explosive composition, fast hydrating self-complexing agents may be used in combination with the above explosive composition. Such agents, once contacted with water, absorb the water and with a cross-linking agent present form a gel to stabilize the explosive composition in the blast hole. In this state, the gelled composition does not flow out of the blast hole.

A variety of quick hydrating self-complexing agents are available as are commonly used in the art. Examples of such complexing hydratable gelling agents include guar gums; Karaya gums; agar gums; pectins; algins and mixtures thereof, or polyacrylamides. The selected agent is in combination with a suitable cross-linking agent to provide for quick hydration and self-complexing in water. It is appreciated that a mixture of gums may be used to provide the hydration aspect independently of the self-complexing gelling aspect. A preferred quick hydrating self-complexing gelling agent is a modified guar gum. Suitable cross-linking agents for use with the gelling agents include sodium dichromate; crystalline sulfamic acid; dilute nitric acid and a saturated solution of ammonium nitrate in liquid ammonia. The guar gums have the ability to absorb 18% or more by weight of water to reach full hydration. With a cross-linking agent present, as the gums become fully hydrated, the cross-linking agent causes the composition to form a gel. There are available in the marketplace guar gums which are provided with a cross-linking agent to provide both the feature of quick hydration and self-complexing in forming the desired gel. Such gums are available from Hi-Tech Polymers, Louisville, Ky.

Another type of suitable gelling agent is a polyacrylamide. The compositon consists of rather long chain molecules which readily absorb water and swell in the process. With a suitable triggering agent present, such as ferric chloride or chromium nitrate, the polyacrylamides as they absorb water also set to form a gel and hence function in the same manner as the modified guar gums.

It has been found that, when the explosive composition including the complexing agents are introduced to a blast hole and only the lower part of the explosive composition in the blast hole is exposed to water, then only the lower portion will cross-link and form a gel. If water does not migrate upwardly of the blast hole, then the upper portion of complexing agent remains dry, yet is perfectly suitable for detonation. This is a significant advantage of the invention, because due to the density of the coated prills they sink immediately in the water of the blast hole and the gelling agent absorbs water present. As that material settles, additional dry explosive composition can be placed on top of the gelled explosive composition to complete filling of the blast hole.

In accordance with an embodiment of this invention, the water resistant explosive composition may comprise the above ingredients in the following proportions:

(i) approximately 4.3% to 27% by weight of an oil/-glycol emulsion including 1% to 6% by weight of an immiscible emulsifiable liquid oil, 0.3% to 5% by weight of an emulsifier and 3% to 16% by weight of an glycol;

(ii) approximately 70% to 95% by weight of an oxidizing salt in the form of granular prills coated with the oil/glycol emulsion to impart water resistance to the prills;

(iii) approximately 0.7% to 3.0% by weight of a hydratable self-complexing gelling agent; and (iv) approximately 0% to 12% by weight of water.

It is appreciated that the explosive composition, according to this invention, will normally be used in the dry condition, that is essentially exclusive of any water. Hence, when the composition is introduced to a blast hole containing water, the complexing agent immediately hydrates and takes in the excess water. In some situations, however, the composition, according to this invention, may be made into a slurry before introduction into the blast hole. This can be accomplished by adding to the composition anywhere up to approximately 12% by weight of water to provide a desired slurry which may be pumped or otherwise transported and introduced to the blast hole. The water has minimal effect on the explosive power of the composition due the prills being coated with the glycol-in-oil emulsion which renders the prills water resistant.

It is also appreciated that the composition, according to this invention, may be sensitized with various additives including sensitizing metals or aluminum and magnesium. Microspheres in the form of glass or borates may be used. Various alcohols and/or peroxides may be included to sensitize the composition to detonation. Alternative to the physical techniques of sensitizing by use of microspheres, the composition may also be sensitized by use of chemical air entraining agents. Such agents include as noted peroxides, such as hydrogen peroxide and sodium peroxide. Other agents include calcium carbide, sodium nitrite and sodium bicarbonate. These chemical air entraining agents cause a foaming action when contacted by water to create micro air bubbles in the gelled composition.

In accordance with standard procedures, the explosive composition may be detonated by use of any of the standard types of primers, boosters, shaped chargers and other high energy initiators. An example of same includes Pentolite (trademark) compositions manufactured by Trojan Corporation, Salt Lake City, Utah.

As noted the guar gums are selected for fast action on exposure to water to ensure that the composition sets up in the blast hole. This eliminates loss of explosive composition from the blast hole should there be large fissures or the like which would permit drainage. The fast hydration is assisted by adding crystalline sulfamic acid or dilute nitric acid to the emulsion coated prills in combination with the guar gums. The use of self-complexing guar gums ensures that once the gums are hydrated, the simultaneous cross-linking will provide permanent water resistance and stability in the blast hole.

EXAMPLE

In accordance with a preferred embodiment of this invention, the following explosive composition was prepared. The glycol-in-oil emulsion may be prepared in any type of mixer of sufficient mixing speed to form a stable, strong emulsion. The ammonium nitrate prills may be coated with the emulsion and mixed with the guar gums and cross-linking agent in any suitable dump ribbon mixer, cement mixer or augers. A typical formulation is as follows:

| | |
|---|---|
| Fuel oil | 2% |
| Sorbitan monooleate | 1% |
| Ethylene glycol | 5% |
| Ammonium nitrate | 89.5% |
| Sulfamic acid | 0.5% |

-continued

| | |
|---|---|
| Guar gums (hydration) | 1% |
| Guar gums (self-complexing) | 1% |

This explosive composition, as mixed and stored in its dry form, has an unconfined critical diameter of 3½ inches when shot with a Trojan 8L (trademark) 227 gram primer. Test shooting when poured through water has proven satisfactory in 6 inch blast holes when initiated with a Trojan 16L (trademark) 454 gram booster.

In accordance with this invention, an explosive composition is provided which has long term water resistance and storage properties. The use of quick hydrating self-complexing gelling agents ensure stability of the product when in the blast hole. The composition may be prepared on site and added directly to blast holes without the need of transporting preformulated compositions from the plant.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A water resistant explosive composition comprising:

(i) approximately 4.3% to 27% by weight of an oil/glycol emulsion including 1% to 6% by weight of an immiscible emulsifiable liquid oil, 0.3% to 5% by weight of an emulsifier and 3% to 16% by weight of a glycol, said emulsion having a density equal to or greater than water;

(ii) approximately 70% to 95% by weight of an oxidizing salt coated with said oil/glycol emusion to impart water resistance to the granules;

(iii) approximately 0.7% to 3.0% by weight of a hydratable self-complexing gelling agent; and (iv) approximately 0% to 12% by weight of water.

2. An explosive composition of claim 1 wherein said glycol is selected from the group consisting of ethylene glycol, diethylene glycol and propylene glycol.

3. An explosive composition of claim 1 wherein said oil is selected from the group consisting of petroleum oils, including heavy motor oils and light oils, vegetable oils, dinitrotoluene, refined mineral oils and white mineral oils.

4. An explosive composition of claim 1 wherein said emulsifier is selected from the group consisting of sorbitan, fatty acid esters of sorbitan, mono- and diglycerides of fat-forming fatty acids, polyoxyethylene sorbitol esters, polyoxyethylene (4) lauryl ether, polyoxyethylene (2) ether, polyoxyethylene (2) stearyl ether, polyoxyalkylene oleate, polyoxyalkylene oleyl acid phosphate, substituted oxazolines, phosphate esters, metallic stearates and emulsified polyacrylamides.

5. An explosive composition of claim 4, wherein said fatty acid esters of sorbitan include sorbitan monolaurate, sorbitan monooleate, and sorbitan tristearate, said polyoxyethylene sorbitol esters include polyoxyethylene sorbitan monooleate and polyethylene sorbitol beeswax derivatives.

6. An explosive composition of claim 1, wherein said oxidizing salt is selected from the group consisting of ammonium nitrate, alkali metal and alkaline earth metal nitrates, perchlorates and mixtures thereof.

7. An explosive composition of claim 6, wherein said alkali metal and alkaline earth metal nitrates include sodium nitrate and calcium nitrate, said perchlorates include sodium perchlorate and potassium perchlorate.

8. An explosive composition of claim 6, wherein said oxidizing agent is ammonium nitrate in the form of granular prills.

9. An explosive composition of claim 1, wherein said hydratable self-complexing gelling agent is selected from the group consisting of guar gums, Karaya gums, agar gums, pectins, algins and mixtures thereof in combination with suitable cross-linking agents to provide for quick hydration and self complexing in water.

10. An explosive composition of claim 9, wherein said hydratable self-complexing gelling agent is guar gum in combination with a cross-linking agent.

11. An explosive composition of claim 1, wherein said hydratable self-complexing gelling agent is a polyacrylamide in combination with a cross-linking agent.

12. An explosive composition of claim 10 or 11, wherein said cross-linking agent is selected from the group consisting of sodium dichromate, crystalline sulfamic acid, dilute nitric acid and a saturated solution of ammonium nitrate in liquid ammonia.

13. An explosive composition of claim 1, comprising:

(i) approximately 8% by weight of a fuel oil/ethylene glycol emulsion including approximately 2% by weight of fuel oil, 5% by weight of ethylene glycol and 1% by weight of sorbitan monooleate;

(ii) approximately 89.5% by weight of ammonium nitrate coated with said emulsion;

(iii) approximately 2% by weight of hydratable and self-complexing guar gums in combination with approximately 0.5% by weight of sulfamic acid.

14. A water resistant explosive composition for use in bore holes which may contain water, said composition comprising in admixture the following components:

(i) granular oxidizing agent;

(ii) a hydratable self-complexing gelling agent when exposed to water, said granular oxidizing agent being coated by, (iii) an emulsion to render thereby said granules as water resistant, said emulsion consisting of an oil emulsified with a water soluble densifying agent, said emulsion having a density equal to or greater than water, said explosive composition comprising said components in a weight ratio which provides an explosive mixture.

15. An explosive composition of claim 14, wherein said emulsion comprises fuel oil emulsified with a glycol in the presence of an emulsifying agent, said glycol having a density significantly greater than water.

16. A glycol-in-oil emulsion for use in coating granular prills of an oxidizing agent used in an explosive, said emulsion comprising sufficient glycol in said emulsion to provide a density equal to or greater than 1, said oil being selected from the group consisting of petroleum oils, including heavy motor oils and light oils, vegetable oils, dinitrotoluene, refined mineral oils and white mineral oils, an emulsifier being selected from the group consisting of sorbitan, fatty acid esters of sorbitan, mono- and diglycerides of fat-forming fatty acids, polyoxyethylene sorbitol esters, polyoxyethylene (4) lauryl ether, polyoxyethylene (2) ether, polyoxyethylene (2) stearyl ether, polyoxyalkylene oleate, polyoxyalkylene oleyl acid phosphate, substituted oxazolines, phosphate esters, metallic stearates and emulsified polyacrylamides, said glycol being selected from the group consisting of ethylene glycol, diethylene glycol and propylene glycol.

17. A glycol-in-oil emulsion of claim 16, wherein said selected oil includes fuel oil, mineral or light oil, said selected emulsifier includes sorbitan monooleate, sorbitan trioleate or polyethoxylated sorbitan monooleate and said selected glycol is ethylene glycol, diethylene glycol or propylene glycol.

18. A glycol-in-oil emulsion of claim 17, wherein said selected oil is fuel oil, said selected emulsifier is sorbitan monooleate, and said selected glycol is ethylene glycol.

19. A process for coating granular oxidizing agent used in an explosive composition to impart water resistance thereto, said process comprising emulsifying a glycol in an oil fuel source in the presence of an emulsifying agent and coating said granules with said emulsion to form coated water repelling granules.

20. A process of claim 19, wherein a hydratable self-complexing agent is added to said composition to add stability to such composition when contacted by water.

21. A process of claim 19, wherein:

(i) approximately 4.3% to 27% by weight of said oil/glycol emulsion is prepared by emulsifying approximately 1% to 6% by weight of said oil with 3% to 16% by weight of a glycol in the presence of 0.3% to 5% by weight of said emulsifying agent and (ii) approximately 70% to 95% by weight of said oxidizing agent, are admixed in a blender in combination with:

(iii) approximately 0.7% to 3.0% by weight of a hydratable self-complexing gelling agent.

22. A process of charging with an explosive a blast hole which contains water comprising charging said blast hole with said explosive composition of claim 1, wherein said composition is essentially free of water.

23. A process of charging with an explosive a blast hole comprising preparing said explosive composition in accordance with the process of claim 21 and charging said explosive into said blast hole.

24. A process of claim 23, wherein said explosive is mixed with up to approximately 12% by weight of water to form an explosive slurry and charging said slurry into said blast hole.

* * * * *